US007394448B2

(12) United States Patent
Park et al.

(10) Patent No.: US 7,394,448 B2
(45) Date of Patent: Jul. 1, 2008

(54) METHOD AND APPARATUS FOR DRIVING LIQUID CRYSTAL DISPLAY DEVICE

(75) Inventors: Man Hyo Park, Gwachun-shi (KR); Min Ho Sohn, Gwangmyoung-shi (KR)

(73) Assignee: LG. Display Co., Ltd, Seoul (KR)

( * ) Notice: Subject to any disclaimer, the term of this patent is extended or adjusted under 35 U.S.C. 154(b) by 578 days.

(21) Appl. No.: 10/734,702

(22) Filed: Dec. 11, 2003

(65) Prior Publication Data

US 2004/0257329 A1 Dec. 23, 2004

(30) Foreign Application Priority Data

Jun. 20, 2003 (KR) ..... 10-2003-0040127

(51) Int. Cl.
*G09G 3/36* (2006.01)

(52) U.S. Cl. ..... 345/102; 345/89

(58) Field of Classification Search ..... 345/99, 345/102, 87–89, 98, 600–604; 348/671–672
See application file for complete search history.

(56) References Cited

U.S. PATENT DOCUMENTS

| | | | | |
|---|---|---|---|---|
| 5,337,068 | A * | 8/1994 | Stewart et al. | 345/88 |
| 5,592,193 | A * | 1/1997 | Chen | 345/102 |
| 7,079,107 | B2 * | 7/2006 | Miyake | 345/102 |
| 2005/0104837 | A1 * | 5/2005 | Baik et al. | 345/99 |
| 2005/0140640 | A1 * | 6/2005 | Oh et al. | 345/102 |

* cited by examiner

*Primary Examiner*—Ricardo Osorio
(74) *Attorney, Agent, or Firm*—Brinks Hofer Gilson & Lione

(57) ABSTRACT

An apparatus for driving a liquid crystal display includes a picture quality improving unit that extracts a brightness component from first data, analyzes the brightness using the extracted brightness component, and generates second data having a contrast in accordance with the analyzed brightness. The contrast of the second data is extended from that of the first data. A timing controller rearranges the second data to supply the second data to a data driver. A backlight supplies the light to a liquid crystal panel in accordance with a driving current. An inverter supplies the driving current to the backlight.

25 Claims, 8 Drawing Sheets

42
70
IMAGE SIGNAL MODULATION UNIT
Ri
Gi
Bi
BRIGHTNESS/COLOR DIVIDING UNIT
50
U
V
DELAYING UNIT
52
UD
VD
BRIGHTNESS /COLOR MIXING UNIT
54
R0
G0
B0
YM
HISTOGRAM MODULATION UNIT
58
HISTOGRAM ANALYZER
56
Y
MEMORY
64
LOOKUP TABLE
66
BACKLIGHT CONTROLLER
60
DIGITAL /ANALOG CONVERTER
62
72
Dimming
CONTROLLER
68
Vsync1
Hsync1
DCLK1
DE1
Vsync2
Hsync2
DCLK2
DE2

METHOD AND APPARATUS FOR DRIVING LIQUID CRYSTAL DISPLAY DEVICE

BACKGROUND OF THE INVENTION

1. Field of the Invention

The present invention relates to a method and apparatus for driving a liquid crystal display, and more particularly to a method and apparatus for driving a liquid crystal display capable of changing a brightness of a display picture in accordance with input data information and partially emphasizing the brightness.

2. Description of the Related Art

A liquid crystal display displays pictures by adjusting light transmittance of liquid crystal cells in accordance with a video signal. The liquid crystal display is embodied with an active matrix type having a switching device formed for each cell and is applied to the display apparatus such as a computer monitor, an office automation apparatus and a cellular phone. A thin film transistor (hereinafter referred to as "TFT") is mainly used as a switching device in the liquid crystal display of an active matrix type.

FIG. 1 schematically illustrates a driving apparatus of the liquid crystal display of the related art.

Referring to FIG. 1, the driving apparatus of the liquid crystal display of the related art comprises a liquid crystal panel 2 in which m×n liquid crystal cells are arranged in a matrix and m data lines D1 to Dm and n gate lines G1 to Gn intersect. A TFT is formed at each interconnection. A data driver 4 supplies a data signal to the data lines D1 to Dm of the liquid crystal panel 22, a gate driver 6 supplies a scan signal to the gate lines G1 to Gn, and a gamma voltage supplier 8 supplies a gamma voltage to the data driver 4. A timing controller 10 controls the data driver 4 and the gate driver 6 by using a synchronization signal provided from a system 20, a DC/DC converter 14 generates voltages supplied to the liquid crystal panel 2 by using a voltage supplied from a power supplier 12 and an inverter 16 drives a backlight 18.

The system 20 supplies to the timing controller 10 vertical/horizontal synchronization signals V sync and H sync, a clock signal DCLK, a data enable signal DE and a data R, G and B.

The liquid crystal panel 2 comprises a plurality of liquid crystal cells Clc arranged in a matrix at the interconnection of the data lines D1 to Dm and the gate lines G1 to Gn. The TFT formed respectively in the liquid crystal cell Clc supplies to the liquid crystal cell Clc the data signal supplied from the data lines D1 to Dm in response to the scan signal supplied from the gate line G. Further, a storage capacitor Cst is formed in each liquid crystal cell Clc. The storage capacitor Cst is formed between a pixel electrode of the liquid crystal cell Clc and a pre-staged gate line or is formed between the pixel electrode of the liquid crystal cell Clc and a common electrode line, thereby maintains a uniform voltage of the liquid crystal cell Clc.

The gamma voltage supplier 8 provides a plurality of gamma voltages to the data driver 4.

The data driver 4 converts a digital video data R, G, and B into an analog gamma voltage (data signal) corresponding to a gray scale value in response to a control signal Cs from the timing controller 10 and supplies the analog gamma voltage to the data lines D1 to Dm.

The gate driver 6 sequentially supplies a scan pulse to the gate lines G1 to Gn in response to the control signal CS from the timing controller 10 to select a horizontal line of the liquid crystal panel 2 to which the data signal is supplied.

The timing controller 10 generates the control signal CS for controlling the gate driver 6 and the data driver 4 by using the vertical/horizontal synchronization signals Vsync and Hsync and the clock signal DCLK received from the system 20. Herein the control signal CS for controlling the gate driver 6 comprises a gate start pulse GSP, a gate shift clock GSC and a gate output enable GOE etc. And the control signal CS for controlling the data driver 4 comprises a source start pulse GSP, a source shift clock SSC, a source output enable SOC and a polarity signal POL etc. And the timing controller 10 rearranges the data R, G, and B supplied from the system 20 to supply the rearranged data to the data driver 4.

The DC/DC converter 14 increases or decreases 3.3 V of a voltage received from the power supplier 12 to produce a voltage to be supplied to the liquid crystal panel 2. The DC/DC converter 14 generates a gamma reference voltage, a gate high voltage VGH, a gate low voltage VGL and a common voltage Vcom.

The inverter 16 supplies a driving voltage (or a driving current) for driving the backlight 18 to the backlight 18. The backlight 18 generates light corresponding to the driving voltage (or the driving current) supplied from the inverter 16 to supply the driving voltage to the liquid crystal panel 2.

In order to display dynamic pictures in the liquid crystal panel 2, the contrast should be clear. However, no method exists that is capable of extending the contrast in accordance with the data in the liquid crystal display of the related art and thus it is difficult to display dynamic pictures. Further in the related art, the backlight 18 of the liquid crystal display constantly and uniformly radiates irrespective of the data. If the backlight 18 constantly and uniformly radiates irrespective of the data, it is difficult to display dynamic and vivid pictures in the liquid crystal panel 2. For example, if an explosion scene is to be vividly displayed, the brightness of the explosion scene should be emphasized. However, since the backlight 18 constantly radiates irrespective of data in the liquid crystal display of the related art, it is difficult to represent the vivid picture. That is, it is impossible to partially emphasize the brightness in the related art.

SUMMARY OF THE INVENTION

Accordingly, one advantage of the embodiments of the present invention are that they provide a method and apparatus for driving a liquid crystal display capable of changing the brightness of a display picture in accordance with input data information and partially emphasizing the brightness.

In one embodiment, an apparatus for driving the liquid crystal display according to an aspect of the present invention comprises a picture quality improving unit that that receives first data, extracts a brightness component for at least one liquid crystal cell of the liquid crystal display from the first data, analyzes brightness of the first data using the extracted brightness component, and generates second data having a contrast extended from that of the first data in accordance with the analyzed brightness; a timing controller that rearranges the second data to supply the second data to a data driver; a backlight that supplies light to the liquid crystal panel in accordance with a driving voltage or current; and an inverter that supplies the driving voltage or current to the backlight.

The inverter may receive a brightness control signal corresponding to the brightness component of the first data from the picture quality improving unit, and supply the driving current corresponding to the brightness control signal to the backlight.

The picture quality improving unit may generate the brightness control signal so that light proportional to the brightness of the brightness component is supplied to the liquid crystal panel from the backlight.

The picture quality improving unit may comprise: an image signal modulation unit that generates the second data using the first data; a backlight control unit that generates the brightness control signal through control of the image signal modulation unit; and a controller that receives a first synchronization signal and changes a received first synchronization signal in synchronization with the second data to supply the first synchronization signal synchronized to the second data to the timing controller.

The image signal modulation unit may comprise: a brightness/color dividing unit that converts the first data into the brightness component and a color-difference component; a histogram analyzer that accumulates the brightness components of a plurality of the liquid crystal cells in each frame into a histogram corresponding to a gray scale to determine brightness information; a histogram modulation unit that generates, for each of at least some of the brightness components, a modulated brightness component having a contrast extended from that of the brightness component using the histogram analyzed from the histogram analyzer; and a brightness/color mixing unit that generates the second data using one of the modulated brightness components and the associated color-difference component.

The image signal modulation unit may further comprise a delaying unit that delays each color-difference component until the brightness information is determined in the histogram analyzer.

The histogram modulation unit may darken a dark part of the brightness component and brighten a bright part to generate the modulated brightness component.

The image signal modulation unit may further comprise: a lookup table that provides reference data used to generate the brightness component in the backlight control unit and the brightness control signal corresponding to the modulated brightness component in the histogram modulation unit; and a memory that temporarily stores the reference data extracted from the lookup table.

The histogram analyzer may supply at least one of a minimum value of brightness, a maximum value of brightness and an average value of brightness to the backlight control unit, and the backlight control unit may generate the brightness control signal in accordance with the at least one of the minimum value of brightness, the maximum value of brightness and the average value of brightness.

The backlight control unit may comprise: a backlight controller that generates the brightness control signal; and a digital/analog converter that converts the brightness control signal generated by the backlight controller into an analog signal.

The liquid crystal panel may be divided into a plurality of regions and the backlight comprises a plurality of lamps, each of the lamps providing light to a different region of the plurality of regions.

The histogram analyzer may analyze the histogram to supply at least one of a frequency of the gray scale for each region, a total frequency of the gray scale, a minimum brightness for each region, and a maximum brightness for each region to the backlight control unit.

The backlight control unit may generate a region brightness control signal supplied to the inverter and subsequently to the lamps such that light proportional to a brightness of each region is supplied from one of the lamps.

In another embodiment, a method for driving a liquid crystal display comprises: accumulating received first data into a histogram corresponding to a gray scale to analyze brightness information; converting the first data into second data having a contrast extended from that of the first data using the brightness information; and rearranging the second data and supplying the second data to a data driver.

The method may further comprise analyzing the brightness information of each frame.

The method may further comprise controlling a backlight in accordance with the brightness information.

The light supplied to a liquid crystal panel from the backlight may be controlled in proportion to a brightness of the brightness information.

The method may further comprise converting synchronization signals to synchronize with the second data.

In another embodiment, a method for driving a liquid crystal display comprises: converting received first data of each of a plurality of liquid crystal cells in a liquid crystal panel into a brightness component and a color-difference component; accumulating the brightness components of a frame into a histogram to analyze brightness information; altering the histogram such that a contrast of each of at least some of the brightness components is extended to generate a converted brightness component; generating second data of which the contrast is extended using the converted brightness component and the associated color-difference component; and rearranging the second data and supplying the second data to the liquid crystal panel through a data driver.

The method may further comprise delaying the color-difference component to synchronize the color-difference component and the converted brightness component.

The method may further comprise converting synchronization signals to synchronize with the second data.

The method may further comprise controlling a backlight in accordance with the brightness information.

The method may further comprise controlling light supplied to the liquid crystal panel from the backlight in proportion to brightness of the brightness information.

The liquid crystal panel may be divided into a plurality of regions and the method further comprise supplying each region with light from one lamp of a plurality of lamps of the backlight.

The method may further comprise analyzing the brightness information of each region and producing region brightness information for each region.

The method may further comprise controlling light of each of the lamps in proportion to the brightness of the region brightness information.

The method may further comprise providing, from a lookup table, reference data used to control the backlight and to alter the histogram.

The method may further comprise temporarily storing the reference data extracted from the lookup table in a memory prior to supplying the reference data.

The method may further comprise experimentally determining the reference data.

The method may further comprise experimentally determining the information prior to the histogram being accumulated.

In another embodiment, an apparatus that increases contrast of images displayed in a liquid crystal display comprises a picture quality improving unit that extracts a brightness component from received first data, generates a modified brightness component having a different gray scale value than the brightness component, and produces second data using the modified brightness component, wherein an image produced using the second data has a higher contrast than an image produced using the first data.

The apparatus may further comprise a data driver that supplies the second data to liquid crystal cells of a liquid crystal panel of the liquid crystal display.

The apparatus may further comprise a backlight that supplies light to the liquid crystal panel proportional to the brightness component.

The apparatus may further comprise a timing controller that rearranges the second data and supplies the rearranged second data to the data driver, wherein the picture quality improving unit comprises: an image signal modulation unit that generates the second data; a backlight control unit that generates a brightness control signal that controls the backlight; and a controller that synchronizes a synchronization signal with the second data and supplies the synchronization signal to the timing controller.

The image signal modulation unit may comprise: a brightness/color dividing unit that converts the first data into the brightness component and a color-difference component; a histogram analyzer that accumulates, for a particular frame, the brightness components of a plurality of the liquid crystal cells into a histogram to determine brightness information; a histogram modulation unit that generates, for each of at least some of the brightness components, the modulated brightness components using the histogram analyzed from the histogram analyzer; and a brightness/color mixing unit that generates the second data using one of the modulated brightness components and the color-difference component associated with the brightness component from which the one of the modulated brightness components was generated.

The image signal modulation unit may further comprise a delaying unit that delays the associated color-difference component such that the one of the modulated brightness components and the associated color-difference component are supplied synchronously to the brightness/color mixing unit.

The histogram modulation unit may generate the modulated brightness components for the brightness components of each of the liquid crystal cells.

The histogram modulation unit may generate the modulated brightness components for the brightness components in each frame.

The image signal modulation unit may further comprise a lookup table that provides reference data used, in the backlight control unit, to control the backlight and, in the histogram modulation unit, to generate the modulated brightness component.

The image signal modulation unit may further comprise a memory that temporarily stores the reference data extracted from the lookup table.

The reference data may exist in the lookup table prior to the histogram being accumulated.

The histogram analyzer may supply at least one of a minimum value of brightness, a maximum value of brightness and an average value of brightness to the backlight control unit, and the backlight control unit may generate the brightness control signal in accordance with the at least one of the minimum value of brightness, the maximum value of brightness and the average value of brightness.

The backlight control unit may comprise: a backlight controller that generates the brightness control signal; and a digital/analog converter that converts the brightness control signal generated by the backlight controller into an analog signal.

The backlight may comprise a plurality of lamps, each of the lamps providing light to a different region of the liquid crystal panel.

The histogram analyzer may analyze the histogram to supply at least one of a frequency of the gray scale for each region, a total frequency of the gray scale, a minimum brightness for each region, and a maximum brightness for each region to the backlight control unit.

The backlight control unit may generate a region brightness control signal that controls the lamps such that light proportional to a brightness of each different region is supplied by a different one of the lamps.

BRIEF DESCRIPTION OF THE DRAWINGS

These and other advantages of the embodiments of the invention will be apparent from the following detailed description of the embodiments of the present invention with reference to the accompanying drawings, in which.

DETAILED DESCRIPTION OF THE PREFERRED EMBODIMENT

Reference will now be made in detail to embodiments of the present invention, examples of which are illustrated in the accompanying drawings.

Hereinafter, as referring to FIGS. 2 to 9, embodiments of the present invention will be explained.

Figure 1:
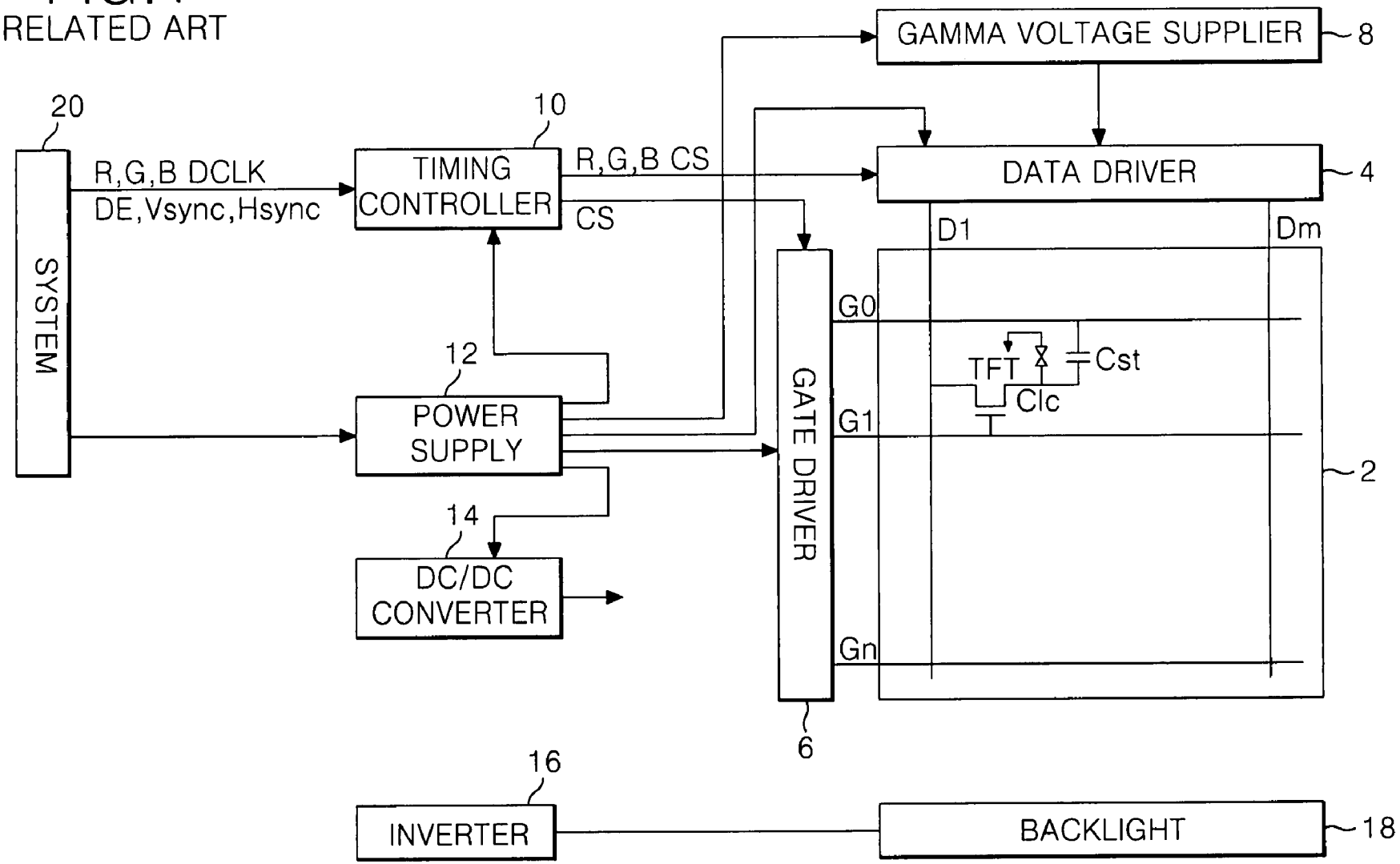
FIG. 1 RELATED ART
FIG. 1 is a block diagram illustrating a driving apparatus of a liquid crystal display of the related art.
Figure 2:
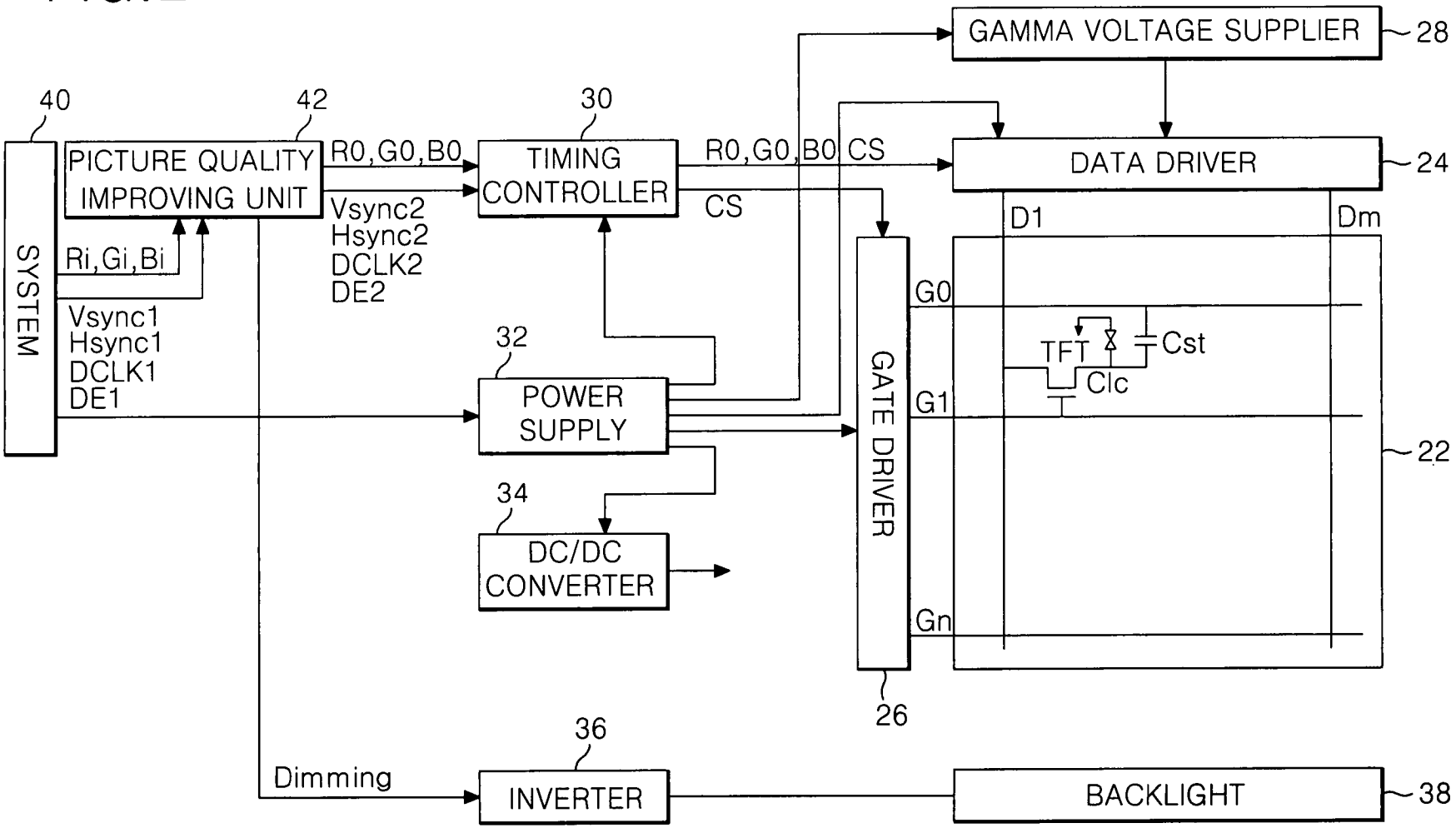
FIG. 2 is a block diagram illustrating a driving apparatus of a liquid crystal display according to an embodiment of the present invention.

FIG. 2 is a block diagram illustrating a driving apparatus of a liquid crystal display according to a first embodiment of the present invention.

Referring to FIG. 2, the driving apparatus of the liquid crystal display according to the embodiment of the present invention comprises a liquid crystal panel 22 where m×n liquid crystal cells are arranged in a matrix and m data lines D1 to Dm and n gate lines G1 to Gn intersect with a TFT formed at each interconnection. A data driver 24 supplies a data signal to the data lines D1 to Dm of the liquid crystal panel 22, a gate driver 26 supplies a scan signal to the gate lines G1 to Gn, and a gamma voltage supplier 28 supplies a gamma voltage to the data driver 24. A timing controller 30 controls the data driver 24 and the gate driver 26 using a second synchronization signal provided from a picture quality improving unit 42, a DC/DC converter 34 generates voltages supplied to the liquid crystal panel 22 using a voltage supplied from a power supplier 32, an inverter 36 drives a backlight 38 and a picture quality improving unit 42 extends the contrast of input data and supplies a brightness control signal (Dimming) corresponding to the input data to the inverter 36.

The system 40 supplies to the picture quality improving unit 42 first vertical/horizontal synchronization signals Vsync1 and Hsync1, a first clock signal DCLK1, a first data enable signal DE1 and first data Ri, Gi and Bi which are the red, green, and blue levels for each of the liquid crystal cells Clc of the liquid crystal panel 22.

The liquid crystal panel 22 comprises a plurality of liquid crystal cells Clc arranged in a matrix at the intersection of the data lines D1 to Dm and the gate lines G1 to Gn. The TFT formed respectively in each liquid crystal cell Clc supplies to the liquid crystal cell Clc the data signal supplied from the data lines D1 to Dm in response to the scan signal supplied from the gate line G. Further, a storage capacitor Cst is formed in each liquid crystal cell Clc. The storage capacitor Cst is formed between a pixel electrode of the liquid crystal cell Clc and a pre-staged gate line or is formed between the pixel electrode of the liquid crystal cell Clc and a common electrode line to thereby uniformly maintain a voltage of the liquid crystal cell Clc.

The gamma voltage supplier 28 provides a plurality of gamma voltages to the data driver 24.

The data driver 24 converts digital video data Ro, Go, and Bo into an analog gamma voltage (data signal) corresponding to a gray scale value in response to a control signal Cs from the timing controller 30 to supply the analog gamma voltage to the data lines D1 to Dm.

The gate driver 26 sequentially supplies a scan pulse to the gate lines G1 to Gn in response to the control signal CS from the timing controller 30 to select a horizontal line of the liquid crystal panel 22 to which the data signal is supplied.

The timing controller 30 generates a control signal (CS) that controls the gate driver 26 and the data driver 24 using the second vertical/horizontal synchronization signals Vsync2 and Hsync2 and the second clock signal DCLK2 received from the picture quality improving unit 42. The control signal CS that controls the gate driver 26 comprises a gate start pulse GSP, a gate shift clock GSC and a gate output enable GOE etc. The control signal CS that controls the data driver 24 comprises a source start pulse SSP, a source shift clock SSC, a source output enable SOC and a polarity signal POL. The timing controller 30 rearranges the second data Ro, Go and Bo supplied from the picture quality improving unit 42 to supply the rearranged second data to the data driver 24.

The DC/DC converter 34 may increase or decrease a 3.3 V voltage provided from the power supplier 32 to produce a voltage to be supplied to the liquid crystal panel 22. The DC/DC converter 34 generates a gamma reference voltage, a gate high voltage VGH, a gate low voltage VGL and a common voltage Vcom.

The inverter 36 supplies to the backlight 38 a driving voltage (or driving current) corresponding to a brightness control signal supplied from the picture quality improving unit 42. In other words, the driving voltage or current supplied from the inverter 36 to the backlight 38 is determined by the brightness control signal supplied from the picture quality improving unit 42. The backlight 38 supplies to the liquid crystal panel 22 light of a brightness corresponding to the driving voltage or current supplied from the inverter 36. Either an edge-type system or a direct-below type system may be selected as the backlight 38. In an edge-type system, the lamp is installed on the outside of the liquid crystal panel and the light incident from the lamp is supplied to the entire surface of the liquid crystal panel through a transparent light guide panel. In a direct-below type system, one or more light sources are mounted on the rear surface of the liquid crystal panel, and the light from the lamp is directly supplied to the liquid crystal panel. Although either system may be used, a direct-below type system may have a higher brightness and a wider light surface compared with the edge-type system, as well as fewer components.

The picture quality improving unit 42 extracts a brightness component for each liquid crystal cell Clc using the first data Ri, Gi and Bi received from the system 40 and generates second data Ro, Go and Bo which have a different gray scale value than that of the first data Ri, Gi and Bi. The picture quality improving unit 42 also generates a brightness control signal corresponding to the extracted brightness component to supply the brightness control signal to the inverter 36. In addition, the picture quality improving unit 42 generates second vertical/horizontal synchronization signals Vsync2 and Hsync2, a second clock signal DCLK2 and a second data enable signal DE2 synchronized to the second data Ro, Go and Bo using the first vertical/horizontal synchronization signal Vsync1 and Hsync1, a first clock signal DCLK1 and a first data enable signal DE1 received from the system 40.

Figure 3:
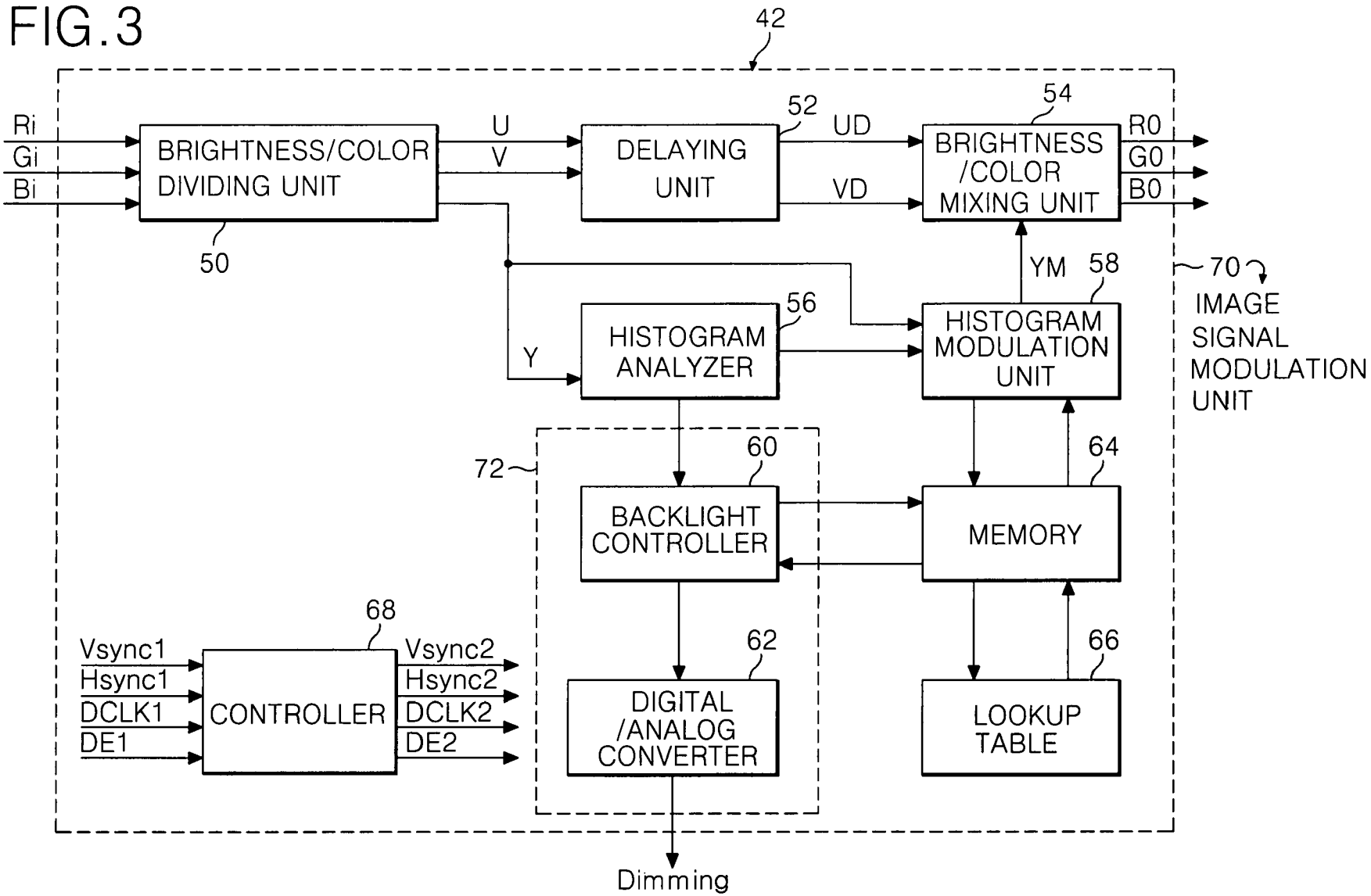
FIG. 3 is a block diagram illustrating in full detail a picture quality improving unit shown in FIG. 2.

The picture quality improving unit 42, as shown in FIG. 3, includes an image signal modulation unit 70 that generates the second data Ro, Go and Bo using the first data Ri, Gi and Bi, a backlight controller unit 72 that generates the brightness control signal (Dimming) through control of the image signal modulation unit 70 and a controller 68 that generates the second vertical/horizontal synchronization signals Vsync2 and Hsync2, the second clock signal DCLK2 and the second data enable signal DE2.

The image signal modulation unit 70 extracts a brightness component Y from the first data Ri, Gi and Bi and generates the second data Ro, Go and Bo. The second data Ro, Go and Bo has a gray scale value that is changed. The image signal modulation unit 70 comprises a brightness/color dividing unit 50, a delaying unit 52, a brightness/color mixing unit 54, a histogram analyzer 56, a histogram modulation unit 58, a memory 64 and a lookup table 66.

The brightness/color dividing unit 50 divides the first data Ri, Gi and Bi of each liquid crystal cell Clc of the liquid crystal panel 22 into the brightness component Y and color-difference components U and V. The brightness component Y and color-difference components U and V for a particular liquid crystal cell are determined using Equations 1 to 3.

$$Y=0.229\times Ri+0.587\times Gi+0.114\times Bi \quad \text{[Equation 1]}$$

$$U=0.493\times(Bi-Y) \quad \text{[Equation 2]}$$

$$V=0.887\times(Ri-Y) \quad \text{[Equation 3]}$$

Figure 4:
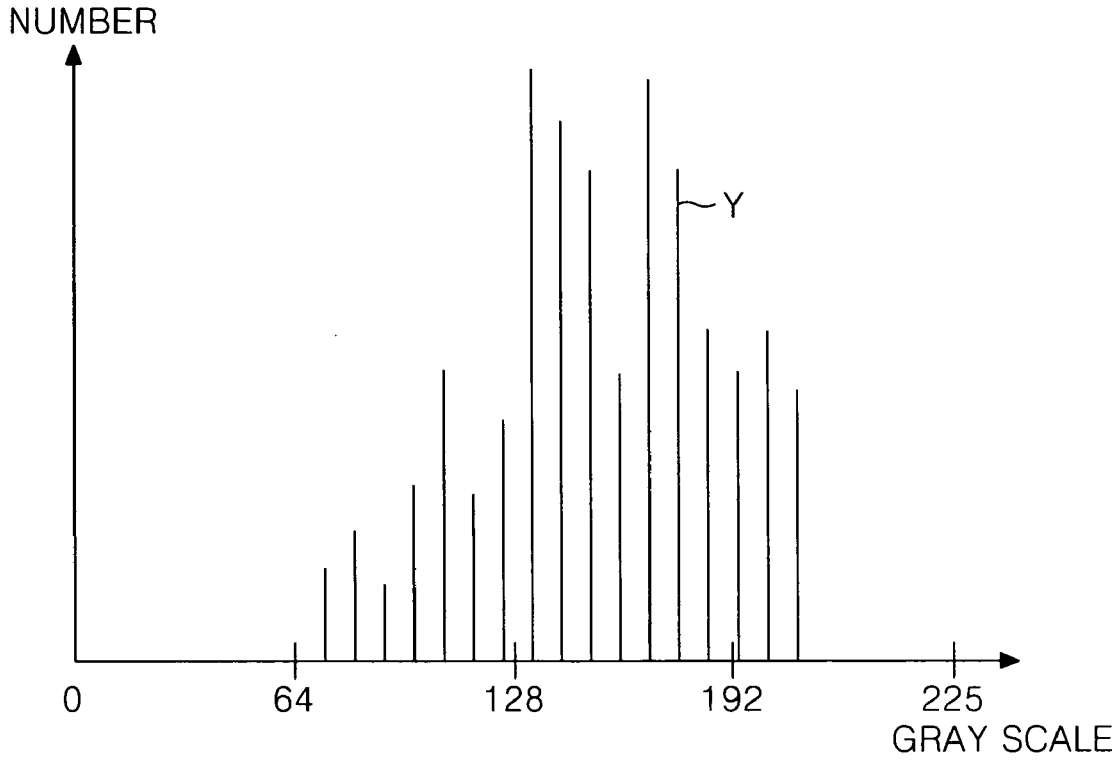
FIG. 4 illustrates a brightness component analyzed in a histogram analyzer shown in FIG. 2.

The histogram analyzer 56 collects the brightness components of the liquid crystal cells Clc in each frame into a histogram or gray scale, such as that shown in FIG. 4. Brightness information of the image is then obtained by analyzing the histogram. For example, if the histogram is inclined to right (high gray scale), the image is primarily bright, and if the histogram is inclined to left (low gray scale), the image is primarily dark. The histogram analyzer 56 analyzes the histogram of the brightness component Y of each frame to determine the brightness information of the frame (e.g. a minimum value, a maximum value and an average value of the brightness). The histogram analyzer 56 then supplies at least one of the minimum value, the maximum value and the average value to the backlight control unit 72.

The histogram modulation unit 58 receives the brightness information and the histogram from the histogram analyzer 56. The histogram modulation unit 58 then generates a modulated brightness component YM for each original brightness component Y and thus extends the contrast of the original histogram. In this arrangement, the modulated brightness component YM is determined from modulation data stored in the lookup table 66.

Figure 5:
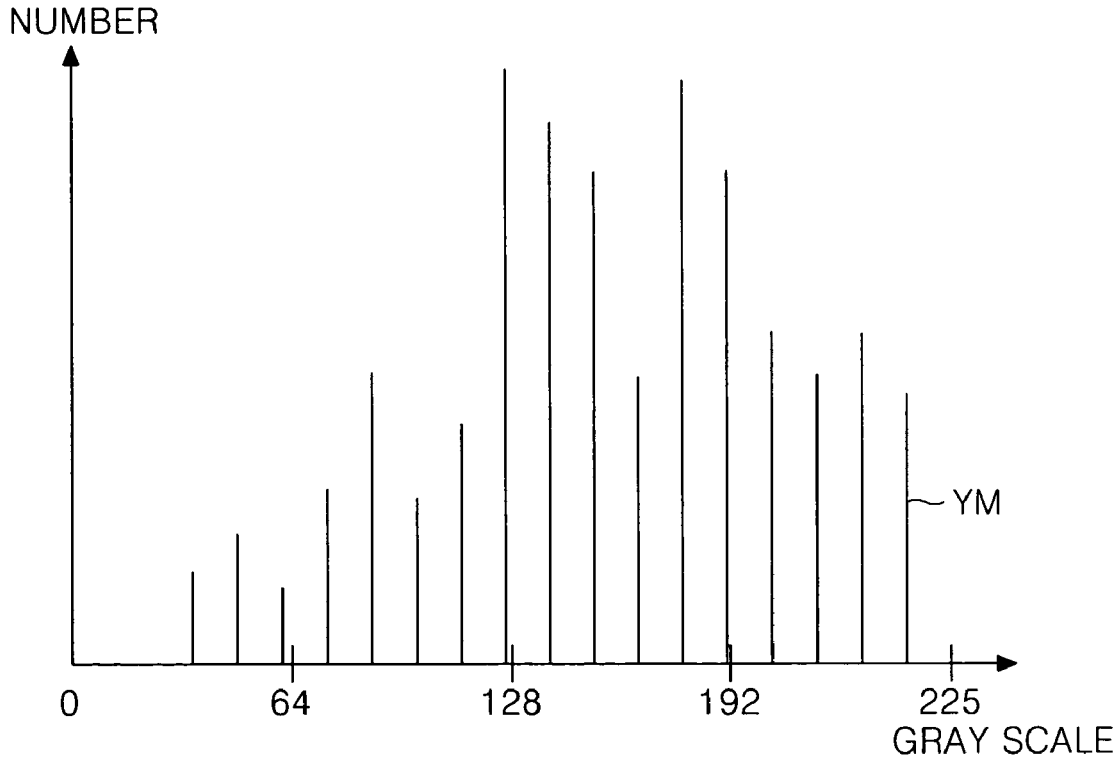
FIG. 5 illustrates a brightness component modulated in a histogram modulation unit shown in FIG. 2.

In fact, a variety of modulation data corresponding to the brightness information is stored in the lookup table 66. In other words, the modulation data of various patterns is stored in the lookup table 66 so that the contrast is correspondingly extended to the designated brightness information. For example, as shown in FIG. 4, when the histogram is provided to the histogram modulation unit 58, the histogram modulation unit 58 refers to the modulation data stored in the lookup table 66 to generate each modulated brightness component YM as shown in FIG. 5. As shown in FIGS. 4 and 5, the brightness components are divided into over 200 channels (different brightness components), although the exact number of channels into which the brightness data is disposed depends on the desired resolution, with an increase in channels providing better image display but more computation power. In FIG. 5, the gray scale of the modulated brightness components YM is distributed over substantially the entire region of the histogram. As described above, if the brightness components YM are distributed over substantially the entire region, the contrast is increased and thus the image appears more clearly. The modulation data stored in the lookup table 66 may be determined experimentally so that the contrast is extended with relation to various histograms. The information in the lookup table 66 thus may be determined prior to the histogram being accumulated in the histogram analyzer 56. The lookup table 66 may be stored in the memory 64. It should be understood that the lookup table 66 is illustrated as being separate from the memory 64 in order to more clearly indicate the lookup table 66. In addition, the modulated data extracted from the lookup table 66 can be temporarily stored in the memory 64.

The driving voltage or current, which is supplied to the backlight 38, is stored in the lookup table 66 and corresponds to at least one of the minimum value, the maximum value and the average value of the brightness in the lookup table 66. The driving voltage or current stored in the lookup table 66 is set so that the contrast is extended as determined by various experiments, which may be performed before the display is shipped from the manufacturer or in situ as the display is used.

The delaying unit 52 delays the color-difference components U and V during analyzation of the brightness components Y in the histogram analyzer 56 and the histogram modulation unit 58. The delaying unit 52 then supplies the delayed color-difference components UD and VD which are synchronized with the modulated brightness components YM to the bright/color mixing unit 54.

The brightness/color mixing unit 54 generates the second data Ro, Go and Bo for each liquid crystal cell Clc in the frame using the modulated brightness component YM and the delayed color-difference components UD and VD. The second data Ro, Go and Bo are determined using Equations 4 to 6.

$$Ro=YM+0.000\times U+1.140\times V \quad \text{[Equation 4]}$$

$$Go=YM-0.396\times U-0.581\times V \quad \text{[Equation 5]}$$

$$Bo=YM+2.029\times U+0.000\times V \quad \text{[Equation 6]}$$

The operation of the image signal modulation unit 70 will be further explained in more detail. First of all, the brightness/color dividing unit 50 divides the first data Ri, Gi and Bi of each liquid crystal cell Clc in a particular frame, using the Equations 1 to 3, into the brightness component Y and the color-difference components U and V. The brightness components Y are provided to the histogram analyzer 56 and the color-difference components U and V are provided to the delaying unit 52.

The histogram analyzer 56 accumulates the brightness components Y into a gray scale for each frame and analyzes the brightness information (e.g. a minimum value, a maximum value and an average value of the brightness) from the gray scale. The histogram analyzer 56 then supplies the brightness information 56 to the backlight control unit 72 and supplies the brightness information and the histogram information to the histogram modulation unit 58.

The histogram modulation unit 58 refers to the lookup table 66 to extend the contrast of the histogram received thereto. In other words, the histogram modulation unit 58 generates an extended brightness component YM for each original brightness component Y. The histogram modulation unit 58 thus generates an extended and modulated histogram and supplies the brightness components YM to the brightness/color mixing unit 54 so that the histogram may be distributed over substantially the entire region. In one example of an extended histogram, the spread between the maximum and minimum modified brightness components is wider than that of the maximum and minimum original brightness components.

The brightness/color mixing unit 54, in response to the delayed color-difference component UD and VD and the modulated brightness component YM generates the second data Ro, Go and Bo using the Equations 4 to 6 for each liquid crystal cell Clc. Since the second data Ro, Go and Bo are generated by the modulated brightness component YM, this provides a clear brightness and darkness for the displayed image. That is, the brightness component YM is distributed over substantially the entire gray scale region to generate second data Ro, Go and Bo having a clear brightness and darkness, whereby vivid pictures can be displayed in the liquid crystal panel 22. In other words, bright colors become brighter and dark color become darker. Thus, the contrast is improved.

Meanwhile, the backlight control unit 72 extracts the driving voltage or current from the lookup table 66 in accordance with at least one of the minimum value, the maximum value and the average value of the brightness supplied from the histogram analyzer 56 to generate a brightness control signal corresponding to the extracted data. The brightness control signal generated from the backlight control unit 72 is supplied to the inverter 36. The backlight control unit 72 comprises a backlight controller 60 and a digital/analog converter 62.

The backlight controller 60 extracts a driving voltage or current from the lookup table 66 that corresponds to at least one of the minimum value, the maximum value and the average value of the brightness supplied from the histogram analyzer 56 to generate a brightness control signal corresponding to the extracted data. More specifically, if the brightness signal analyzed in the histogram analyzer 56 has a high brightness, the backlight controller 60 generates a digital control signal to produce light of a high brightness. However if the brightness signal analyzed in the histogram analyzer 56 has a low brightness, the backlight controller 60 generates a digital control signal to produce light of a low brightness.

The digital to analog converter 62 converts the digital control signal into an analog control signal and supplies the analog control signal to the inverter 36. The inverter 36, in response to the analog brightness control signal, supplies a driving voltage or current corresponding to the brightness control signal to the backlight 38. The backlight 38 generates light of a brightness corresponding to the driving voltage or current supplied from the inverter 36, which is then supplied to the liquid crystal panel 22. That is, the backlight controller 60 controls light from the backlight 38 so that bright colors are displayed more brightly and dark colors are displayed more darkly. This permits pictures with a higher contrast to be displayed in the liquid crystal panel 22.

The controller 68 receives the first vertical/horizontal synchronization signals Vsync1 and Hsync1, the first clock signal DCLK1, and the first data enable signal DE1 provided from the system 40. The controller 68 generates the second vertical/horizontal synchronization signals Vsync2 and Hsync2, the second clock signal DCLK2 and the second data enable signal DE2 in synchronization with the second data Ro, Go and Bo and supplies the second vertical/horizontal synchronization signals, the second clock signal and the second data enable signal to the timing controller 30.

Figure 6:
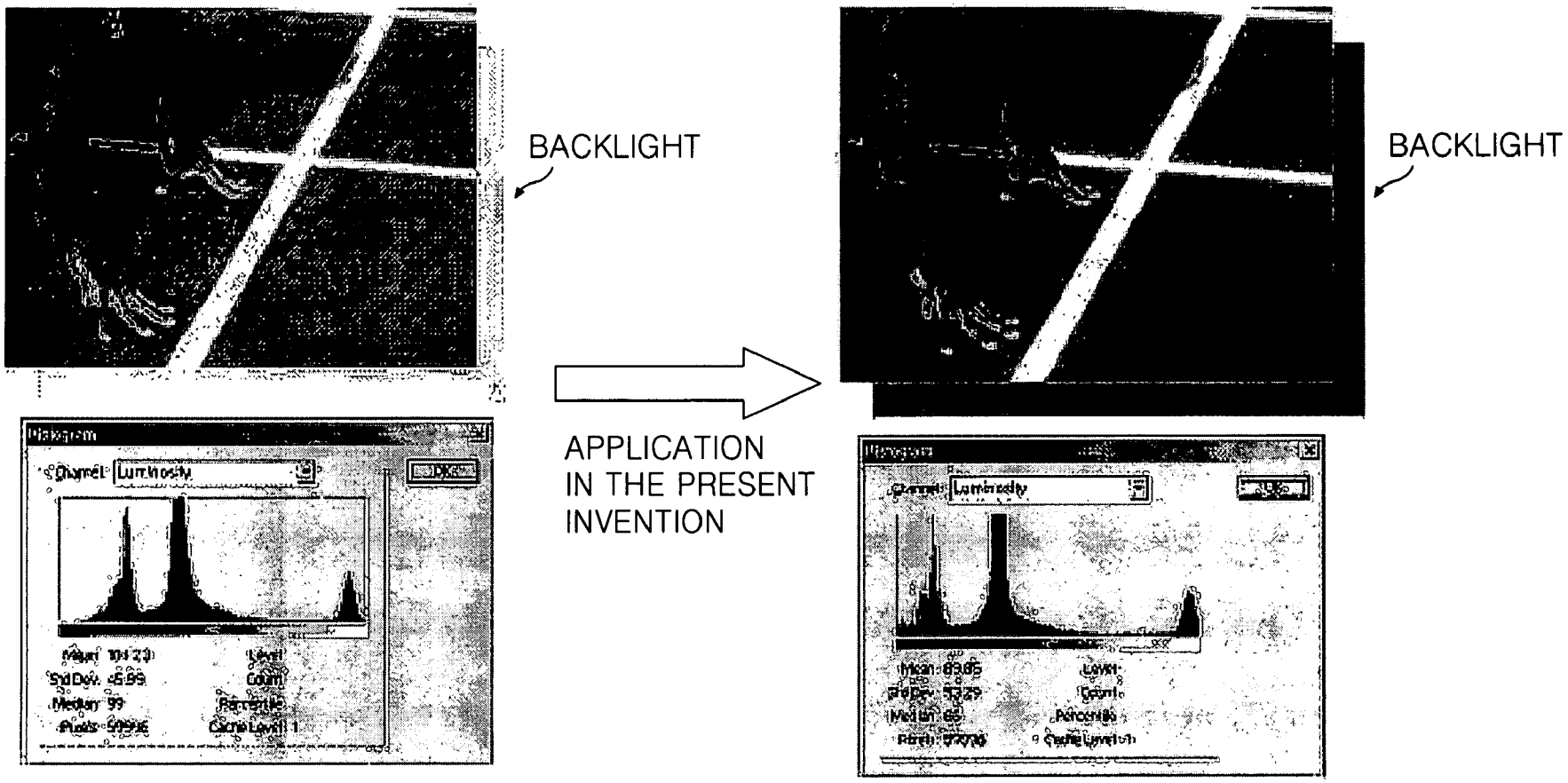
FIG. 6 is a comparison of a picture according to an embodiment of the present invention that of the related art.

The liquid crystal display apparatus of the above embodiment of increases the contrast of the entire display using the brightness component of the data to display dynamic and vivid pictures. Bright parts (e.g. lines) are further brightened and dark parts (shadows, tracks) are further darkened. The brightness of the backlight 38 is also adjusted in accordance with the brightness of the image in each frame to thereby display vivid and dynamic pictures as shown in FIG. 6. As can be seen in FIG. 6, since many dark portion sexist, the brightness of the backlight 38 is accordingly decreased. Further, the tube current of the backlight 38 is adjusted to thereby reduce the power consumption of the backlight 38.

Figure 7:
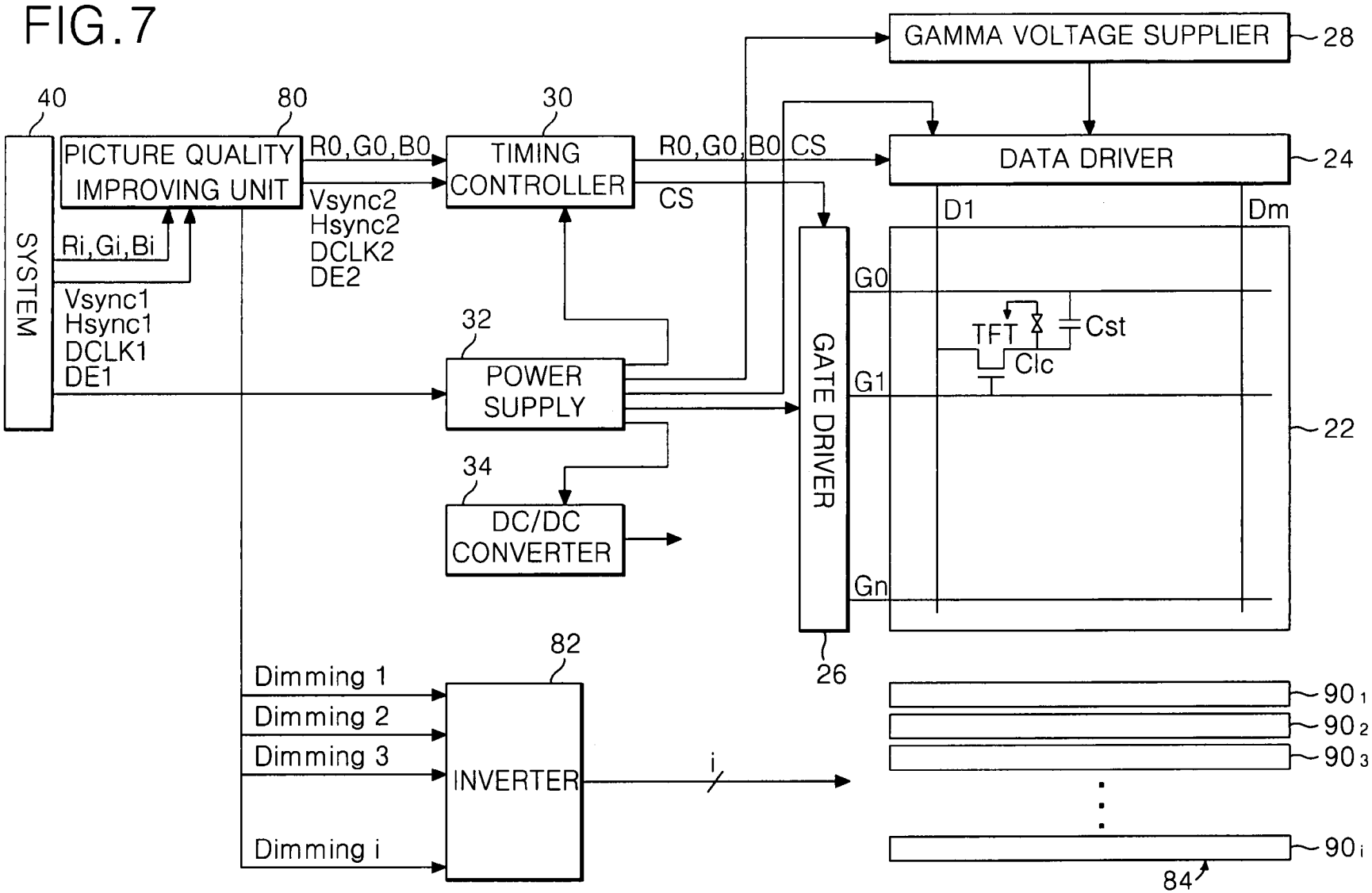
FIG. 7 is a block diagram illustrating a driving apparatus of a liquid crystal display according to the other embodiment of the present invention.

FIG. 7 is a block diagram illustrating a driving apparatus of the liquid crystal display according to a second embodiment of the present invention. In FIG. 7, the same reference numerals are assigned to blocks performing the same functions at that shown in FIG. 2, and detailed explanations of these blocks will be omitted.

Referring to FIG. 7, the liquid crystal display according to the second embodiment of the present invention comprises a liquid crystal panel 22 having a TFT formed at intersections wherein m×n liquid crystal cells Clc are arranged in a matrix of m data lines D1 to Dm and n gate lines G1 to Gn, a data driver 24 supplies data signals to the data lines D1 to Dm of the liquid crystal panel 22, a gate driver 26 supplies scan signals to the gate lines G1 to Gn, and a gamma voltage supplier 28 supplies gamma voltages to the data driver 24. A timing controller 30 controls the data driver 24 and the gate driver 26 using the second synchronization signal supplied from the picture quality improving unit 80, a DC/DC converter 34 generates voltages supplied to the liquid crystal panel 22 using the voltage provided from the power supply 32, an inverter 82 drives the backlight 84, and a picture quality improving unit 80 supplies to the inverter 82 brightness control signals Dimming 1 to Dimming i that individually control a plurality of lamps $\mathbf{90}_1, \mathbf{90}_2, \mathbf{90}_3, \ldots, \mathbf{90}_i$ (i is an integer) and extends the contrast of the input data.

The system 40 supplies a first vertical/horizontal synchronization signal Vsync1 and Hsync1, a first clock signal DCLK1, a first data enable signal DE1 and first data Ri, Gi, and Bi to the picture quality improving unit 42.

The liquid crystal display comprises liquid crystal cells Clc disposed in a matrix. The liquid crystal cells Clc display a designated picture corresponding to the data signal supplied from the data driver 24.

The gamma voltage supplier 28 supplies a plurality of gamma voltages to the data driver 24.

The data driver 24 converts the video data Ro, Go, and Bo supplied thereto to the data signal using a gamma voltage, and supplies the data signal to the data lines D1 to Dm. The gate driver 26 sequentially supplies a scan pulse to the gate lines G1 to Gn to select a particular liquid crystal cell.

The timing controller 30 generates a control signal CS that controls the gate driver 26 and the data driver 24 using a second vertical/horizontal synchronization signal Vsync2 and Hsync2 provided from the picture quality improving unit 80. The timing controller 30 rearranges the second data Ro, Go, and Bo provided from the picture quality improving unit 80 to supply the provided data to the data driver 24. The DC/DC converter 34 steps-up or steps-down 3.3 volts provided from the power supplier 32 to generate a gamma reference voltage, a gate high voltage VGH, a gate low voltage VGL and a common voltage Vcom.

The inverter 82 supplies to the backlight 84 the driving voltage or current corresponding to the brightness control signals Dimming 1 to Dimming i supplied from the picture quality improving unit 80. The picture quality improving unit 80 supplies i brightness control signals Dimming 1 to Dimming i (i.e. the total number of brightness control signals) to the inverter in order to each of the lamps $\mathbf{90}_1$ to $\mathbf{90}_i$. The inverter 82 supplies driving voltages or currents respectively corresponding to the i brightness control signals Dimming 1 to Dimming i to the lamps $\mathbf{90}_1$ to $\mathbf{90}_i$. The driving voltages or currents may be different from or identical to each other. That is, the brightness of the lamps $\mathbf{90}_1$ to $\mathbf{90}_i$ within one frame can be set differently. Essentially, the lamps $\mathbf{90}_1$ to $\mathbf{90}_i$ correspond to the brightness control signals Dimming 1 to Dimming i to selectively control the brightness of light provided to the liquid crystal panel 22.

In the backlight 84, the direct-below type system including a plurality of lamps $\mathbf{90}_1$ to $\mathbf{90}_i$ is employed. A plurality of lamps $\mathbf{90}_1$ to $\mathbf{90}_i$ are mounted on the rear surface of the liquid crystal panel 22 to supply to the liquid crystal panel light corresponding to the driving voltage or current supplied from the inverter 82. On the other hand, the liquid crystal panel 22 corresponds to mounting location of the lamps $\mathbf{90}_1$ to $\mathbf{90}_i$ and can be divided into i regions. In other words, the liquid crystal panel 22 can be divided into a first region having light supplied from the first lamp $\mathbf{90}_1$, a second region having light supplied from the second lamp $\mathbf{90}_2$, and an $i^{th}$ region having light supplied from the $i^{th}$ lamp $\mathbf{90}_i$, etc. Essentially, the picture quality improving unit 80 generates bright control signals Dimming 1 to Dimming i in accordance with the data supplied to each of the regions of the liquid crystal panel 22.

The picture quality improving unit 80 extracts the brightness component of each liquid crystal cell Clc in a particular frame using the first data Ri, Gi, and Bi provided from the system 40 to generate the second data Ro, Go, and Bo, changing the gray scale value of the first data Ri, Gi, and Bi. The picture quality improving unit 80 generates i brightness control signals Dimming 1 to Dimming i using the brightness components and frequency provided to i regions of the liquid crystal panel 22 and supplies the generated brightness control signals Dimming 1 to Dimming i to the inverter 82. Further, the picture quality improving unit 80 generates the second vertical/horizontal synchronization signal Vsync2 and Hsync2, the second clock signal DCLK2 and the second data enable signal DE2 synchronized with the second data Ro, Go, and Bo using the first vertical/horizontal synchronization signal Vsync1 and Hsync1, the first clock signal DCLK1, and the first data enable signal DE1 provided from the system 40.

Figure 8:
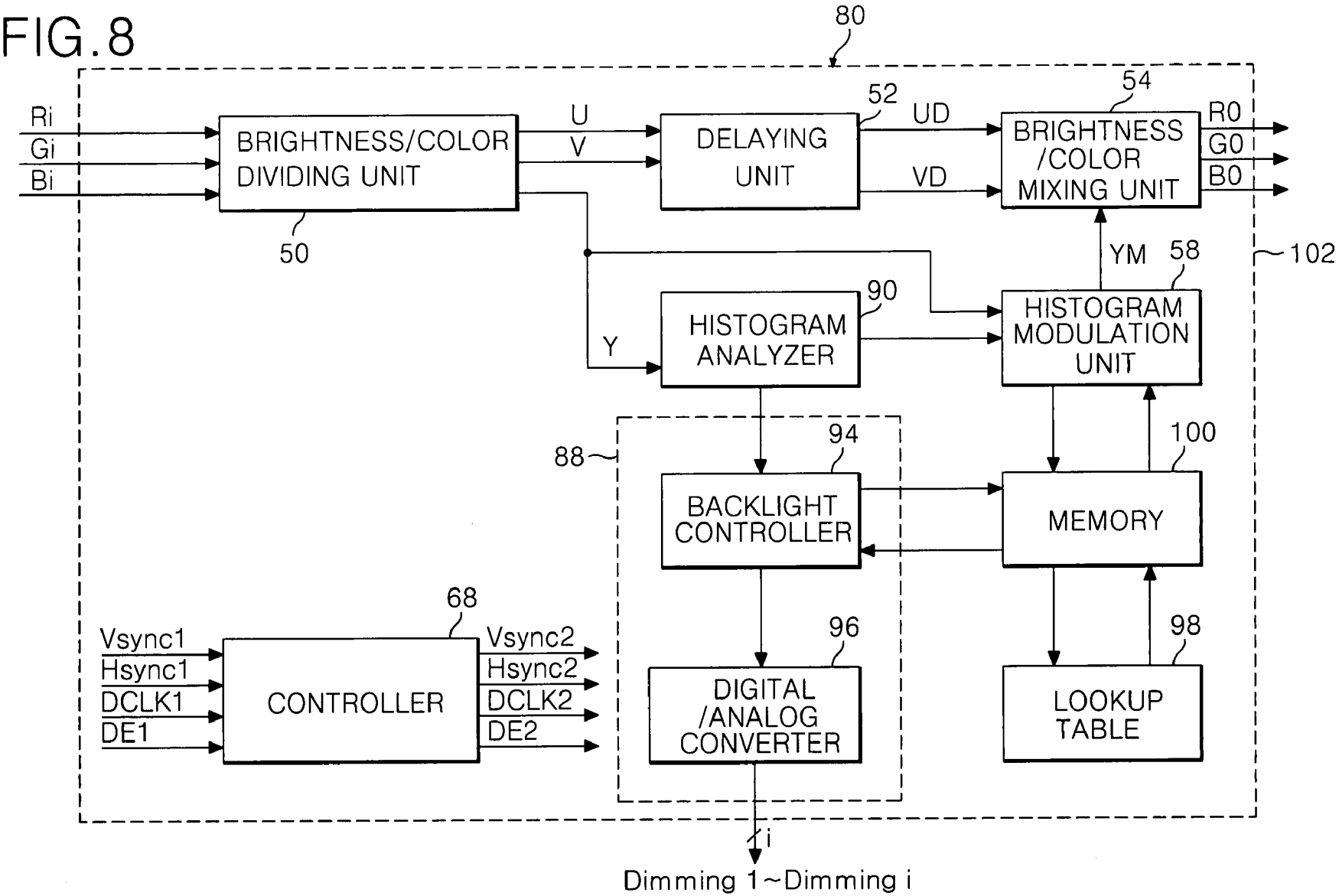
FIG. 8 is a block diagram illustrating in full detail a picture quality improving unit shown in FIG. 7.

The construction of the picture quality improving unit 80 is shown in FIG. 8.

FIG. 8 illustrates the picture quality improving unit 80 according to the second embodiment of the present invention. In FIG. 8, the same reference numerals are assigned to blocks performing the same functions as in FIG. 3. Thus, detailed explanations of these blocks will be omitted.

Referring to FIG. 8, the picture quality improving unit 80 comprises an image signal modulation unit 102 that generates the second data Ro, Go, and Bo using the first data Ri, Gi, and Bi, a backlight control unit 88 that generates the brightness control signals Dimming 1 to Dimming i through control of the image signal modulation unit 102, and a controller 68 that generates the second vertical/horizontal synchronization signal Vsync1 and Hsync1, the second clock signal DCLK2 and the second data enable signal DE2.

The image signal modulation unit 102 extracts the brightness component Y from the first data Ri, Gi and Bi and generates the second data Ro, Go and Bo having an altered gray scale value using the extracted brightness component Y. The image signal modulation unit 102 controls the backlight control unit 88 referring to the brightness and the frequency of the data respectively supplied to the i regions of the liquid crystal panel 22. As shown, the image signal modulation unit 102 comprises a brightness/color dividing unit 50, a delaying unit 52, a brightness/color mixing unit 54, a histogram analyzer 90, a histogram modulation unit 58, a memory 100 and a lookup table 98.

The brightness/color dividing unit 50 divides the first data Ri, Gi, and Bi of each liquid crystal cell Clc of each frame into a brightness component Y and color difference components U and V using Equations 1 to 3.

The histogram analyzer 90 accumulates the brightness components Y of each frame into the gray scale of the frame. In other words, the histogram analyzer 90 collects the brightness components Y and separates the brightness components Y into a gray scale to acquire the histogram shown in FIG. 4. Thus, a total frequency of each gray scale can be acquired. The histogram analyzer 90 analyzes at least one of the minimum brightness, the maximum brightness and the region frequency of the gray scale for each of the i regions of the liquid crystal panel. Explaining this in more detail, the liquid crystal panel 22 is divided into i regions that correspond to the lamps $\mathbf{90}_1$ to $\mathbf{90}_i$. After the histogram is produced, the histogram analyzer 90 analyzes the gray scale value for each of the regions of the brightness (including the minimum brightness and the maximum brightness) and the region frequency of the gray scale supplied to each of the regions of the liquid crystal panel 22. The histogram analyzer 90 supplies at least one of the total frequency of the analyzed gray scale, the region frequency of the gray scale and the gray scale value for each region to the backlight control unit 88. For example, the total frequency and the region frequency can be supplied to the backlight control unit 88.

The histogram modulation unit 58 receives the brightness information and the histogram from the histogram analyzer 90 to generate modulated brightness components YM in which the contrast of the received histogram is extended. The histogram modulation unit 58 refers to the modulation data stored in the lookup table 98 to generate the modulated brightness components YM.

Various modulation data corresponding to the brightness information is stored in the lookup table 98. In other words, the modulation data of various patterns is stored so that the contrast may be extended in accordance with the designated brightness information. For example, as shown in FIG. 4, when the histogram is provided to the histogram modulation unit 58, the histogram modulation unit 58 refers to the modulation data stored in the lookup table 98 to generate the modulated brightness component YM for each original brightness component Y, as shown in FIG. 5. The gray scale of the modulated brightness components YM is distributed over substantially the entire region. If the brightness components YM are distributed over substantially the entire region, the contrast between darkness and brightness can be increased. The modulation data stored in the lookup table 98 is determined experimentally so that the contrast may be extended in accordance with the various histograms. The lookup table 98 may be stored in the memory 100, although as shown in FIG. 8, the memory 100 and the lookup 98 are separated and depicted in order to better represent the lookup table 98. Alternatively, the modulation data extracted from the lookup table 98 can be temporarily stored in the memory 100.

The driving voltage or current to be supplied to the backlight unit 84 in accordance with at least one of the total frequency of the gray scale, the region frequency of the gray scale and the gray scale value for each region (including the minimum brightness and the maximum brightness) is stored in the lookup table 98. Here, the contrast of the driving voltage or current stored in the lookup table 98 is extended and the driving voltage or current is determined experimentally so that vivid pictures may be displayed.

The delaying unit 52 delays the color-difference components U and V while the brightness component Y is analyzed in the histogram analyzer 56 and the histogram modulation unit 58. The brightness/mixing unit 54 receives the modulated brightness component YM and the delayed color-difference components UV and VD and generates the second data Ro, Go and Bo using Equations 4 to 6 of each liquid crystal cell Clc for each frame.

Explaining the operation process of the image signal modulation unit 102 in more detail, first the brightness/color dividing unit 50 changes the first data Ri, Gi and Bi for each liquid crystal cell Clc using Equations 1 to 3 into the brightness component Y and the color-difference components U and V. The brightness component Y is provided to the histogram analyzer 90, and the color-difference components U and V are provided to the delaying unit 52.

The histogram analyzer 90 receiving the brightness components Y accumulates the brightness components Y into a gray scale for each frame, and analyzes the brightness information (the region frequency for each gray scale, the total frequency for each gray scale, and the gray scale value for each region) from the brightness components Y. Hereinafter, the histogram analyzer 90 supplies the brightness information to the backlight control unit 88. And, the histogram analyzer 90 supplies the histogram information to the histogram modulation unit 58.

The histogram modulation unit 58 refers to the lookup table 98 to extend the contrast of the histogram received to itself. That is, the histogram modulation unit 58 generates a brightness component YM for each original brightness component Y in which the histogram is extended. The brightness components YM are supplied to the brightness/color mixing unit 54 so that the histogram is distributed over substantially the entire gray scale region.

The brightness/color mixing unit 54 receiving the delayed color-difference components UV and VD and the modulated brightness component YM generates the second data Ro, Go, and Bo for each liquid crystal cell Clc using Equations 4 to 6. The second data Ro, Go, and Bo has extended contrast because of being generated by the modulated brightness component YM. That is, the brightness components YM are distributed over substantially the entire gray scale region to generate the second data Ro, Go, and Bo having increased contrast. This allows vivid images to be displayed in the liquid crystal panel 22. In other words, bright colors are displayed more brightly and dark colors are displayed more darkly, thereby emphasizing the overall contrast of the image.

On the other hand, the backlight control unit 88 extracts the driving voltage or current from the lookup table 98 in accordance with at least one of the region frequency for each gray scale, the total frequency for each gray scale and the gray scale value for each region supplied from the histogram analyzer 90. The backlight control unit 88 then generates the brightness control signals Dimming 1 to Dimming i corresponding to that the driving voltage or current. The brightness control signals Dimming 1 to Dimming i corresponds to the regions of the liquid crystal panel 22, that is, the lamps $\mathbf{90}_1$ to $\mathbf{90}_i$ to be generated. The brightness control signals Dimming 1 to Dimming i generated from the backlight control unit 88 are supplied to the inverter 82.

The backlight control unit 88 thus comprises a backlight controller 94 and a digital/analog converter 96.

The backlight controller 94 extracts the driving voltage or current from the lookup table 98 in accordance with at least one of the region frequency for each gray scale, the total frequency for each gray scale and the gray scale value for each region supplied from the histogram analyzer 90. The backlight controller 94 then generates the brightness control signals Dimming 1 to Dimming i corresponding to that. If one or more special regions have a particularly high brightness, the brightness control signals are generated so that light of a high brightness is generated, and if the one or more special regions have a low brightness, the brightness control signal is generated so that light of a low brightness is generated. The digital/analog converter 96 converts digital brightness control signals Dimming 1 to Dimming i supplied from the backlight controller 94 into analog brightness control signals Dimming 1 to Dimming i and supply these signals to the inverter 82.

The inverter 82 receiving the brightness control signals Dimming 1 to Dimming i supplies the driving voltages or currents corresponding to the brightness control signals Dimming 1 to Dimming i to the lamps $\mathbf{90}_1$ to $\mathbf{90}_i$. The lamps $\mathbf{90}_1$ to $\mathbf{90}_i$ generate light of a brightness corresponding to the driving voltage or current supplied from the inverter 82 to supply the generated light to the liquid crystal panel 22. The brightness of the light supplied to each region of the liquid crystal panel 22 is determined in accordance with the brightness of the data supplied to each region. That is, the lamps $\mathbf{90}_1$ to $\mathbf{90}_i$ are controlled so that bright colors are displayed more brightly and dark colors are displayed more darkly. Thereby, pictures having obvious contrast can be better displayed in the liquid crystal panel 22. Further, since the brightness of the light supplied for each of the regions is determined in accordance with the brightness of the data supplied to each of the regions, vivid and the dynamic pictures can be better displayed.

As above, the controller 68 receives the first vertical/horizontal synchronization signals Vsync1 and Hsync1, the first clock signal DCLK1, and the first data enable signal DE1 received from the system 40. The controller 68 then generates the second vertical/horizontal synchronization signals Vsync2 and Hsync2, the second clock signal DCLK2, and the second data enable signal DE2 in synchronization with the second data Ro, Go, and BO to supply these signals to the timing controller 30.

Figure 9:
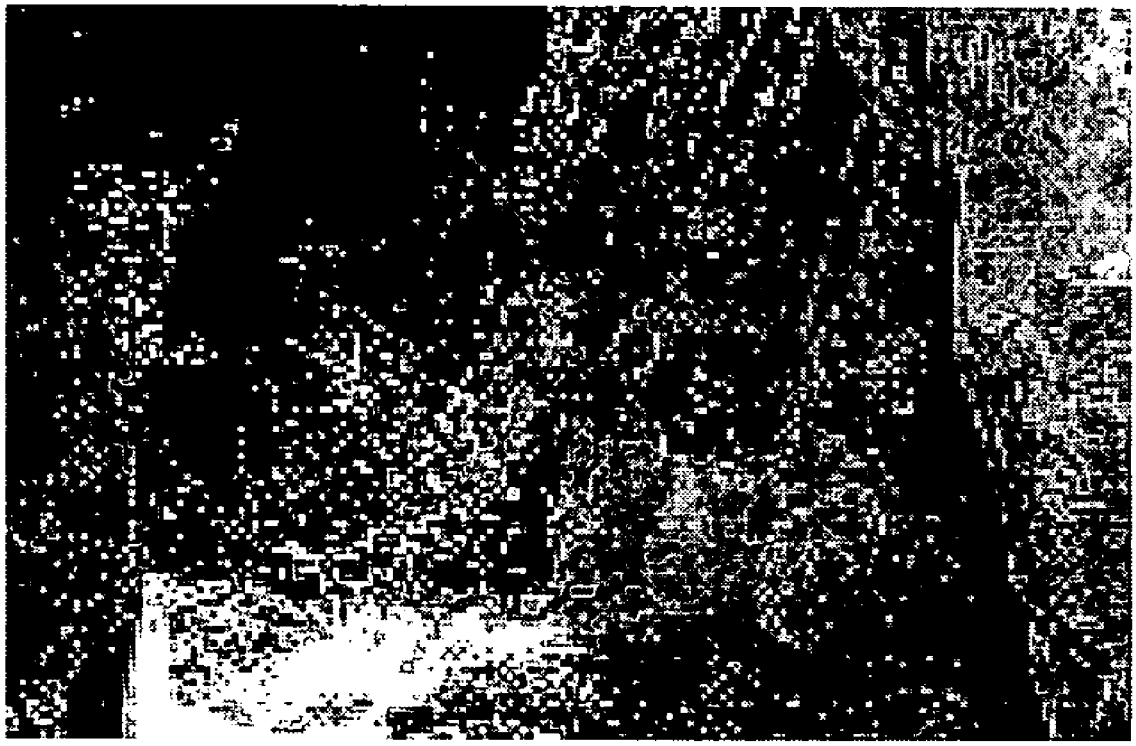
FIG. 9 is a picture of a liquid crystal display according to another embodiment of the present invention.

The liquid crystal display according to the second embodiment of the present invention produces an image in which substantially the entire contrast is obvious using the brightness components Y of the data, thereby permitting vivid and dynamic pictures to be displayed. Since the brightness of the light supplied to the regions of the liquid crystal panel is controlled in accordance with the brightness of the data, dynamic moving pictures can be implemented. FIG. 9 is an example of an image displayed using the second embodiment of the present invention in which selective emphasis within one frame illustrates that vivid and dynamic pictures can be displayed. Further, this embodiment of the present invention adaptively adjusts a tube current of the backlight 84, thereby reducing the power consumption.

As described above, the method and apparatus of driving the liquid crystal display according to the present invention extracts the brightness component from the input data, and provides a dark color that is more dark and a bright color that is more bright than the extracted brightness components. This permits display of pictures in which the contrast is more obvious. Further, the liquid crystal display controls the brightness of the backlight in accordance with the extracted brightness component and thereby permits vivid and dynamic pictures to be displayed. Further, the liquid crystal display may divide the liquid crystal panel into regions corresponding to a plurality of backlights and control the brightness of the backlight in accordance with the brightness of the data supplied to the divided regions. Such an arrangement provides selective emphasis of portions of the pictures. In addition, selective control of the brightness of the backlight permits a reduction in the power consumption of the backlight and thus the overall liquid crystal device.

Although the present invention has been explained in accordance with the embodiments shown in the drawings, it should be understood to the ordinary skilled person in the art that the invention is not limited to the embodiments, but rather that various changes or modifications thereof are possible without departing from the spirit of the invention. For example, although the above embodiments describe arrangements in which the histogram of each frame is reviewed and modified accordingly, multiple consecutive frames may be modified in the same manner before a new frame is reviewed and perhaps modified in a different manner. Such a method may decrease the computation time without much detriment if the image does not change appreciably from frame to frame. Or, only one or more portions of the gray scale may be modified to increase the contrast, rather than the entire gray scale, to emphasize the contrast between only certain portions. Accordingly, the scope of the invention shall be determined only by the appended claims and their equivalents.

What is claimed is:

1. An apparatus for driving a liquid crystal, comprising:

a picture quality improving unit that receives first data, extracts a brightness component for at least one liquid crystal cell of the liquid crystal display from the first data, analyzes brightness of the first data using the extracted brightness component, and generates second data having a contrast extended from that of the first data in accordance with the analyzed brightness;

a timing controller that rearranges the second data to supply the second data to a data driver;

a backlight that supplies light to the liquid crystal panel divided into a plurality of regions in accordance with a driving voltage or current, wherein the backlight comprises a plurality of lamps, each of the lamps providing light to a different region of the plurality of regions; and an inverter that supplies the driving voltage or current to the backlight;

wherein the picture quality improving unit controls individually the plurality of lamps so that light proportional to the brightness of the each region is supplied to the liquid crystal panel from the backlight.

2. The apparatus according to claim 1, wherein the inverter receives a brightness control signal corresponding to the brightness component of the first data from the picture quality improving unit, and supplies the driving current corresponding to the brightness control signal to the backlight.

3. The apparatus according to claim 2, wherein the picture quality improving unit generates the brightness control signal so that light proportional to the brightness of the brightness component is supplied to the liquid crystal panel from the backlight.

4. The apparatus according to claim 2, wherein the picture quality improving unit comprises:

an image signal modulation unit that generates the second data using the first data;

a backlight control unit that generates the brightness control signal through control of the image signal modulation unit; and a controller that receives a first synchronization signal and changes a received first synchronization signal in synchronization with the second data to supply the first synchronization signal synchronized to the second data to the timing controller.

5. The apparatus according to claim 4, wherein the image signal modulation unit comprises:

a brightness/color dividing unit that converts the first data into the brightness component and a color-difference component;

a histogram analyzer that accumulates the brightness components of a plurality of the liquid crystal cells in each frame into a histogram corresponding to a gray scale to determine brightness information;

a histogram modulation unit that generates, for each of at least some of the brightness components, a modulated brightness component having a contrast extended from that of the brightness component using the histogram analyzed from the histogram analyzer; and a brightness/color mixing unit that generates the second data using one of the modulated brightness components and the associated color-difference component.

6. The apparatus according to claim 5, wherein the image signal modulation unit further comprises a delaying unit that delays each color-difference component until the brightness information is determined in the histogram analyzer.

7. The apparatus according to claim 5, wherein the histogram modulation unit darkens a dark part of the brightness component and brightens a bright part to generate the modulated brightness component.

8. The apparatus according to claim 5, wherein the image signal modulation unit comprises:

a lookup table that provides reference data used to generate the brightness component in the backlight control unit and the brightness control signal corresponding to the modulated brightness component in the histogram modulation unit; and a memory that temporarily stores the reference data extracted from the lookup table.

9. The apparatus according to claim 5, wherein the histogram analyzer supplies at least one of a minimum value of brightness, a maximum value of brightness and an average value of brightness to the backlight control unit, and the backlight control unit generates the brightness control signal in accordance with the at least one of the minimum value of brightness, the maximum value of brightness and the average value of brightness.

10. The apparatus according to claim 9, wherein the backlight control unit comprises:

a backlight controller that generates the brightness control signal; and a digital/analog converter that converts the brightness control signal generated by the backlight controller into an analog signal.

11. The apparatus according to claim 5, wherein the histogram analyzer analyzes the histogram to supply at least one of a frequency of the gray scale for each region, a total frequency of the gray scale, a minimum brightness for each region, and a maximum brightness for each region to the backlight control unit.

12. The apparatus according to claim 11, wherein the backlight control unit generates a region brightness control signal supplied to the inverter and subsequently to the lamps such that light proportional to a brightness of each region is supplied from one of the lamps.

13. An apparatus that increases contrast of images displayed in a liquid crystal display, comprising:

a picture quality improving unit that extracts a brightness component from received first data, generates a modified brightness component having a different gray scale value than the brightness component, and produces second data using the modified brightness component, wherein an image produced using the second data has a higher contrast than an image produced using the first data;

a data driver that supplies the second data to liquid crystal cells of a liquid crystal panel of the liquid crystal display;

a backlight that supplies light to the liquid crystal panel divided into a plurality of regions, wherein the backlight comprises a plurality of lamps, each of the lamps providing light to a different region of the plurality of regions; and wherein the picture quality improving unit controls individually the plurality of lamps so that light proportional to the brightness of the each region is supplied to the liquid crystal panel from the backlight.

14. The apparatus according to claim 13, further comprising a timing controller that rearranges the second data and supplies the rearranged second data to the data driver, wherein the picture quality improving unit comprises:

an image signal modulation unit that generates the second data;

a backlight control unit that generates a brightness control signal that controls the backlight; and a controller that synchronizes a synchronization signal with the second data and supplies the synchronization signal to the timing controller.

15. The apparatus according to claim 14, wherein the image signal modulation unit comprises:

a brightness/color dividing unit that converts the first data into the brightness component and a color-difference component;

a histogram analyzer that accumulates, for a particular frame, the brightness components of a plurality of the liquid crystal cells into a histogram to determine brightness information;

a histogram modulation unit that generates, for each of at least some of the brightness components, the modulated brightness components using the histogram analyzed from the histogram analyzer; and a brightness/color mixing unit that generates the second data using one of the modulated brightness components and the color-difference component associated with the brightness component from which the one of the modulated brightness components was generated.

16. The apparatus according to claim 15, wherein the image signal modulation unit further comprises a delaying unit that delays the associated color-difference component such that the one of the modulated brightness components and the associated color-difference component are supplied synchronously to the brightness/color mixing unit.

17. The apparatus according to claim 15, wherein the histogram modulation unit generates the modulated brightness components for the brightness components of each of the liquid crystal cells.

18. The apparatus according to claim 15, wherein the histogram modulation unit generates the modulated brightness components for the brightness components in each frame.

19. The apparatus according to claim 15, wherein the image signal modulation unit comprises a lookup table that provides reference data used, in the backlight control unit, to control the backlight and, in the histogram modulation unit, to generate the modulated brightness component.

20. The apparatus according to claim 19, wherein the image signal modulation unit further comprises a memory that temporarily stores the reference data extracted from the lookup table.

21. The apparatus according to claim 19, wherein the reference data exists in the lookup table prior to the histogram being accumulated.

22. The apparatus according to claim 15, wherein the histogram analyzer supplies at least one of a minimum value of brightness, a maximum value of brightness and an average value of brightness to the backlight control unit, and the backlight control unit generates the brightness control signal in accordance with the at least one of the minimum value of brightness, the maximum value of brightness and the average value of brightness.

23. The apparatus according to claim 22, wherein the backlight control unit comprises:

a backlight controller that generates the brightness control signal; and a digital/analog converter that converts the brightness control signal generated by the backlight controller into an analog signal.

24. The apparatus according to claim 15, wherein the histogram analyzer analyzes the histogram to supply at least one of a frequency of the gray scale for each region, a total frequency of the gray scale, a minimum brightness for each region, and a maximum brightness for each region to the backlight control unit.

25. The apparatus according to claim 24, wherein the backlight control unit generates a region brightness control signal that controls the lamps such that light proportional to a brightness of each different region is supplied by a different one of the lamps.

* * * * *